US009303466B2

(12) United States Patent
Makelki et al.

(10) Patent No.: US 9,303,466 B2
(45) Date of Patent: Apr. 5, 2016

(54) SUCKER ROD CENTRALIZER

(75) Inventors: Leroy A. Makelki, Edmonton (CA); Mark A. Lea-Wilson, Edmonton (CA); Damon B. Larson, Sherwood Park (CA)

(73) Assignee: Plainsman Mfg. Inc., Edmonton, Alberta (CA)

( * ) Notice: Subject to any disclaimer, the term of this patent is extended or adjusted under 35 U.S.C. 154(b) by 883 days.

(21) Appl. No.: 13/250,712

(22) Filed: Sep. 30, 2011

(65) Prior Publication Data

US 2012/0193089 A1 Aug. 2, 2012

Related U.S. Application Data

(60) Provisional application No. 61/438,897, filed on Feb. 2, 2011.

(51) Int. Cl.
*E21B 17/10* (2006.01)

(52) U.S. Cl.
CPC ..... *E21B 17/1071* (2013.01)

(58) Field of Classification Search
CPC ..... F16B 7/06; F16B 7/182; E21B 17/1071; F16L 15/00; F16L 15/02; F16L 15/08
USPC ..... 166/241.2; 403/299; 285/332.3
See application file for complete search history.

(56) References Cited

U.S. PATENT DOCUMENTS 1,605,316 A * 11/1926 Wilson ..... 166/241.2
1,814,271 A * 7/1931 Vaughn ..... 166/241.2
1,849,075 A * 3/1932 Dardelet ..... 403/343
2,575,685 A * 11/1951 Shugart et al. ..... 285/298
3,885,461 A * 5/1975 Crisp ..... F16B 39/16 403/259
4,548,431 A * 10/1985 Hall et al. ..... 285/334
4,757,861 A * 7/1988 Klyne ..... 166/241.3
4,919,202 A * 4/1990 Clintberg ..... 166/176
4,938,299 A 7/1990 Jelsma
5,810,100 A 9/1998 Samford
5,941,312 A 8/1999 Vermeeren
2006/0216178 A1 * 9/2006 Sindt et al. ..... 418/45

FOREIGN PATENT DOCUMENTS

CN 201723180 U * 1/2011

* cited by examiner

*Primary Examiner* — William P Neuder
*Assistant Examiner* — Ronald Runyan
(74) *Attorney, Agent, or Firm* — Anthony R. Lambert

(57) ABSTRACT

A coupling assembly is disclosed for connecting and centralizing a first threaded-end member and a second threaded-end member, the coupling assembly comprising: a mandrel having a rotor receiving surface bounded by a first stop and a second stop, the mandrel having a first threaded pin at a first end for connection to a first threaded box coupling for the first threaded-end member, and a second threaded pin at a second end for connection to a second threaded box coupling for the second threaded-end member; each of the first stop and the second stop having respective outer diameters and the respective outer diameters being less than or equal to the respective outer diameters of the first threaded box coupling and the second respective box coupling; and a rotor with raised fins mounted on the rotor receiving surface between the first stop and the second stop.

4 Claims, 12 Drawing Sheets

SUCKER ROD CENTRALIZER

CROSS-REFERENCE TO RELATED APPLICATIONS

This application claims the benefit under 35 USC 119(e) of U.S. provisional application Ser. No. 61/438,897 filed Feb. 2, 2011.

BACKGROUND AND TECHNICAL FIELD

The present disclosure relates to a centralizing assembly for connecting segments of sucker rods together and to space the connected sucker rod sections away from the sides of the well.

Once a well has been established for the production of fluid hydrocarbons it is often necessary to pump the fluid out of the well when the fluid has a high viscosity or a relatively low pressure. Most artificial lift wells in the U.S. and Canada consist of a downhole pump attached to a surface power source by series of connected sucker rods. Each sucker rod is machined from a solid rod approximately 25 to 30 feet long with a central diameter between ⅝" and 1⅛" with a threaded pin and shoulder at either end of the rod. A "sucker rod coupling" is a cylindrically internally threaded member and is used to connect segments of sucker rod together to create an assembly called a "sucker rod string". The sucker rod couplings are typically 4" long and have a larger outer diameter than the raised shoulders of the sucker rod.

The sucker rod string is fed through a concentric tubing string consisting of 30 foot sections of tubing which are threaded together and typically have a nominal inside diameter between 2⅜" and 4½". The function of the sucker rod string is to actuate the downhole pump to force fluid to the surface by pumping the fluid flow through the annulus formed by the sucker rod string and the tubing string. Progressing cavity pumps, will rotate the sucker rod string and reciprocating pumps will move the sucker rod string up and down the axial direction of the sucker rod string.

The present disclosure was developed for applications with rotating sucker rod strings. It will be discussed herein in connection with the problems associated with rotating sucker rod strings, particularly those applications which exert high torques on the sucker rod string downhole. However, the product can be used in reciprocating pumping also.

When sucker rod string is rotated within a well that deviates from vertical, the string tends to lie on the one side of the tubing and the rod string rotates eccentrically about this point. This eccentric motion allows the steel sucker rod couplings, which have a larger outer diameter than the sucker rod, to slap and grind against the steel tubing causing wear and severe damage to the tubing wall. The resulting tubing wall failure is disastrous for the well operation and requires expensive repairs. It has become industry practice to centralize the rod string within the tubing with a soft non-metallic material to prevent steel-on-steel contact between the couplings and the tubing wall. This soft non-metallic centralizer, or guide, can be mounted on the rod string in a variety of methods. However, mounting the centralizer at the connecting point of a pair of sucker rods ensures that the large diameter couplings are prevented from contacting the tubing wall. If the centralizer were mounted on the narrow sucker rod stem in the center of the sucker rod the couplings might still contact the tubing wall.

The industry has recently been experimenting with high strength materials and alternative manufacturing techniques in the production of sucker rods resulting in the ability to apply higher amounts of torque to the rod string downhole. However, the same couplings and guides are being used to connect the rod string. In order for the centralizer mandrel to transmit the higher torque without material failure a greater bearing contact surface between the mandrel and the couplings was required. However, in a standard one-piece centralizer design as the bearing contact surface increases, the shoulder area formed by the interface of the mandrel and the couplings which fixes the soft non-metallic centralizer rotor decreases and results in premature failure, axial travel of the rotor and severe tubing wall damage.

U.S. Pat. No. 4,919,202 issued to Clintberg discloses a sucker rod guide bearing having a free spinning vaned rotor of soft resilient material which is fixed by two large diameter washers and a mandrel which are attached to sucker rod couplings. However, the bearing surface formed between the mandrel and the free spinning washer does maximize the contact area given that the diameter of the mandrel is less than that of the coupling. Consequently, the sucker rod guide bearing is not suitable for high torque applications. The metallic washer with a larger diameter than the coupling also introduces the likelihood of metal-metal contact with the tubing wall once the rotor has been worn down. While the resulting metal-metal wear is generally less damaging, given the washer is softer than the tubing wall, the large diameter washer is undesirable as the large diameter and sharp edge are have the possibility to leave severe localized wear on the tubing.

SUMMARY

The present disclosure originated from an effort to develop a sucker rod centralizer assembly for high torque applications that would reduce wear of the tubing wall caused by sucker rod couplings.

There is thus provided a coupling assembly for connecting and centralizing a first threaded-end member and a second threaded-end member, the coupling assembly comprising a mandrel having a rotor receiving surface bounded by a first stop and a second stop, the mandrel having a first threaded pin or box at a first end for connection to a first threaded box coupling or sucker rod pin end of the first threaded-end member, and a second threaded pin or box at a second end for connection to a second threaded box coupling or sucker rod pin end of the second threaded-end member; and a rotor with raised fins mounted on the rotor receiving surface between the first stop and the second stop. Each of the first stop and the second stop have respective outer diameters and the respective outer diameters are less than or preferably equal to the respective outer diameters of the first threaded box coupling and the second respective box coupling.

In a first embodiment, the stops are provided by undercuts, and the mandrel is made of at least two parts. In a second embodiment, one or both stops may be created by threaded nuts on a mandrel. Further summary is found in the claims.

A coupling assembly is disclosed for connecting and centralizing a first threaded-end member and a second threaded-end member, the coupling assembly comprising: a mandrel having a rotor receiving surface bounded by a first stop and a second stop, the mandrel having a first threaded pin at a first end for connection to a first threaded box coupling for the first threaded-end member, and a second threaded pin at a second end for connection to a second threaded box coupling for the second threaded-end member; each of the first stop and the second stop having respective outer diameters and the respective outer diameters being less than or equal to the respective outer diameters of the first threaded box coupling and the second respective box coupling; and a rotor with raised fins mounted on the rotor receiving surface between the first stop and the second stop.

A coupling assembly is disclosed for connecting and centralizing a pair of elongated threaded-end members, comprising: (a) a pair of box couplings: (b) a pair of circular shoulders with an outer diameter approximately equal to those of the couplings, at least one of said shoulders being defined by a nut, which may include wrench flats for assembly purposes; (c) a mandrel connected to and extending between the couplings and shoulders, said mandrel having a set of sucker rod threads on either end of the mandrel; (d) a tubular body with external vanes mounted with a loose fit on the shaft and fixed axially by the shoulders having a length less than the space between said shoulders, said centralizer rotor extending radially outward beyond the longitudinal surfaces of the couplings, said centralizer rotor being formed of resilient abrasion-resistant non-metallic material, said centralizer rotor acts as a sacrificial wear surface with regard to the tubing wall. Each shoulder may be defined by a nut, the mandrel having a set of nut threads on one or both ends of the mandrel.

A coupling assembly is also disclosed for connecting and centralizing a first threaded-end member and a second threaded-end member, the coupling assembly comprising: a mandrel having an undercut bounded by a first shoulder and a second shoulder, the undercut having a cylindrical surface between the first shoulder and the second shoulder, the mandrel having a first threaded pin at a first end for connection to a first threaded box coupling for connection to the first threaded-end member, and a second threaded pin at a second end for connection to a second threaded box coupling for connection to the second threaded-end member; each of the first shoulder and the second shoulder having respective outer diameters and the respective outer diameters being less than or equal to the respective outer diameters of the first threaded box coupling and the second respective box coupling; and a tubular sleeve with raised fins mounted on the substantially cylindrical surface of the undercut between the first shoulder and the second shoulder.

A coupling assembly is also disclosed for connecting and centralizing a pair of elongated threaded-end members, comprising: (a) a pair of box couplings or sucker rod pin ends; (b) a two-piece shaft connected to and extending between the couplings, said shaft having an outer diameter approximately equal to that of the couplings, said shaft having an undercut to fix the rotor axially; (c) a tubular body with external vanes mounted with a loose fit on the shaft undercut and fixed axially by the shoulders of the undercut having a length less than said undercut, said centralizer rotor extending radially outward beyond the longitudinal surfaces of the couplings, said centralizer rotor being formed of resilient abrasion-resistant non-metallic material, said centralizer rotor acts as a sacrificial wear surface with regard to the coupling and tubing wall.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1A:
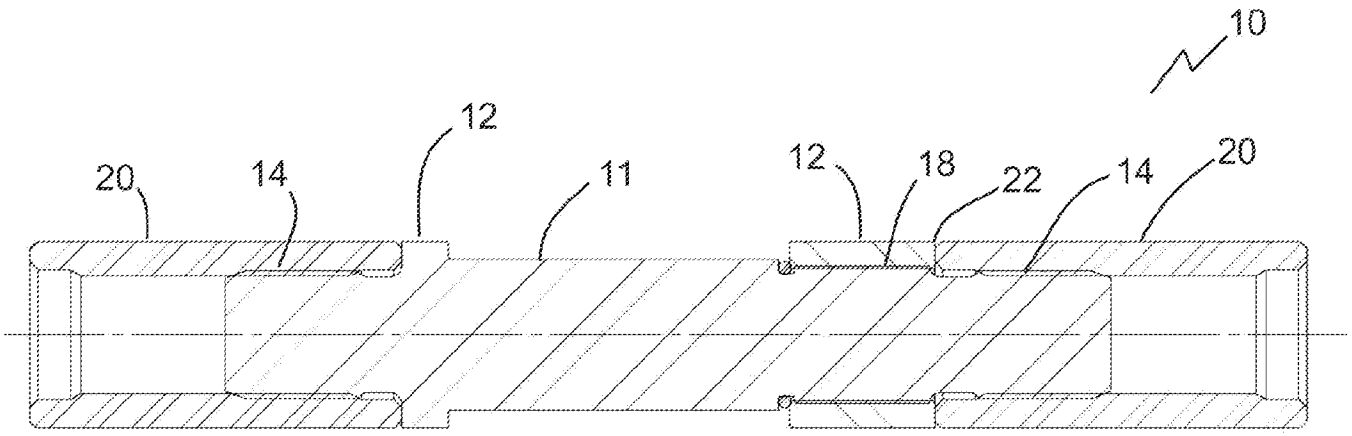
FIG. 1A is a section view taken along the A-A section lines of FIG. 1.
Figure 1:
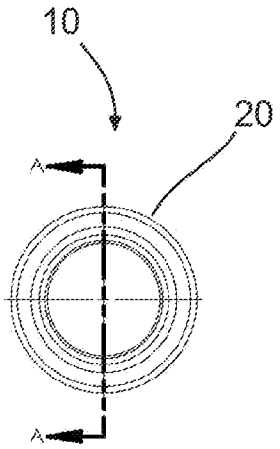
FIG. 1 is an end elevation view of a coupling assembly for connecting to a first threaded-end member and a second threaded-end member, and with the rotor removed.
Figure 2:
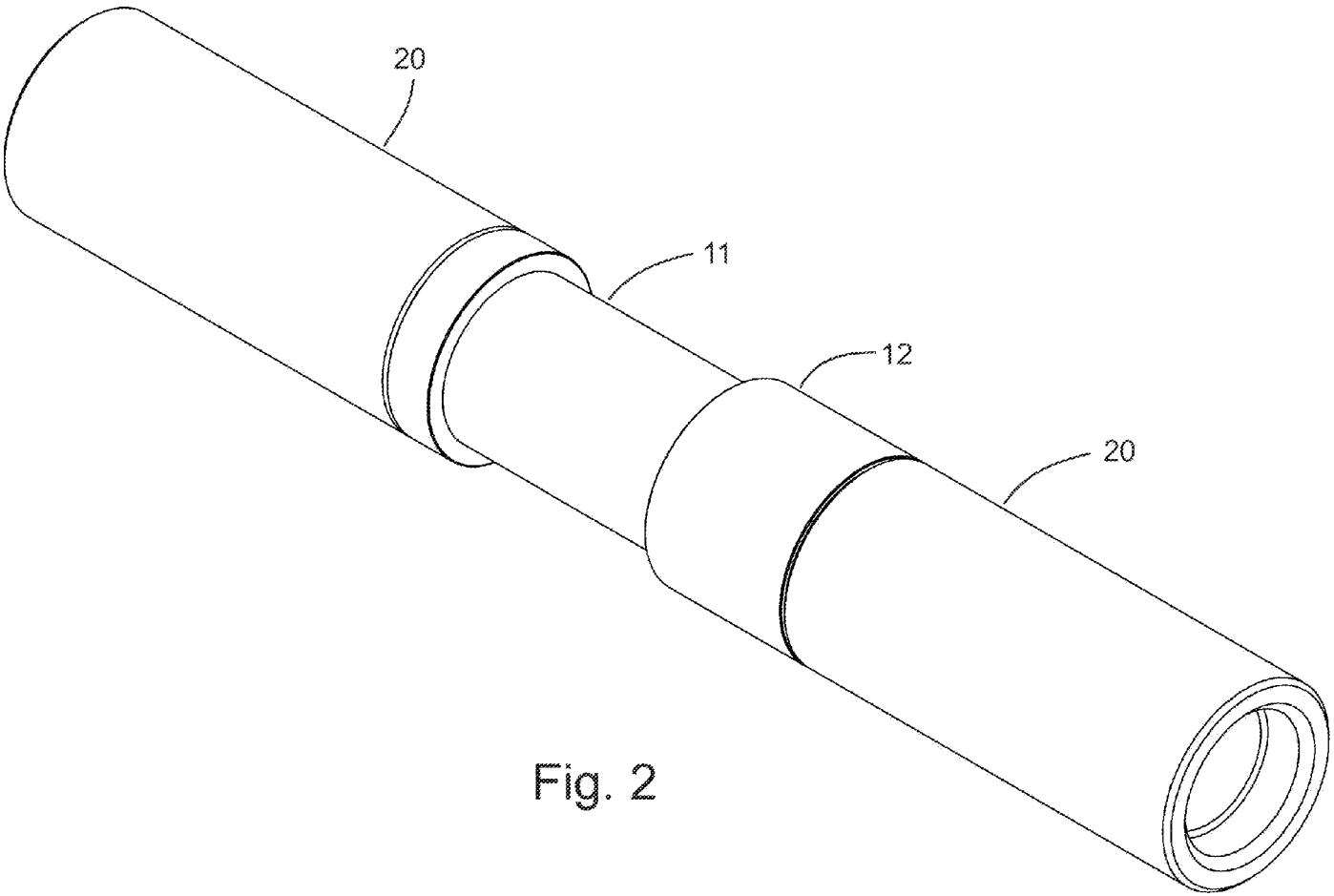
FIG. 2 is a perspective view of the coupling assembly of FIG. 1.
Figure 3:
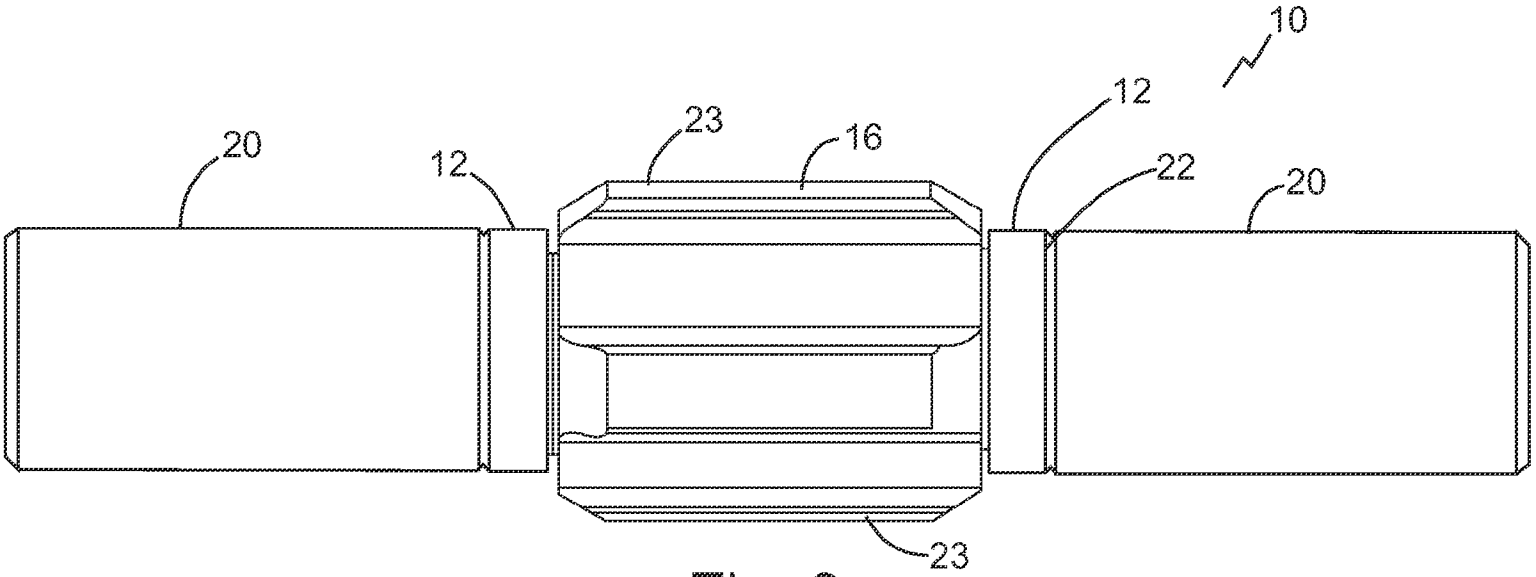
FIG. 3 is a side elevation view of the coupling assembly of FIG. 1 with a rotor installed.
Figure 4:
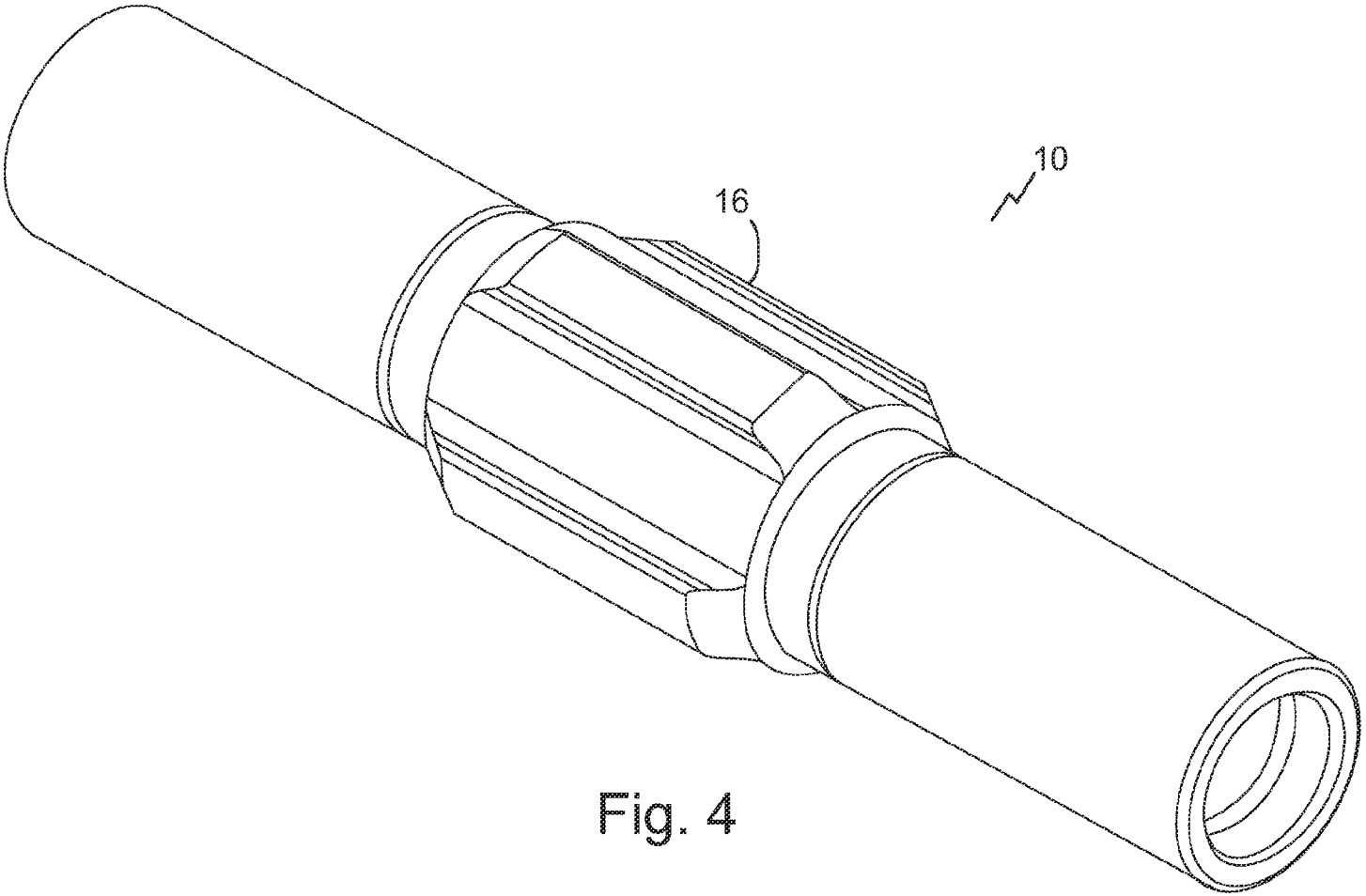
FIG. 4 is a perspective view of the coupling assembly of FIG. 3.
Figure 12A:
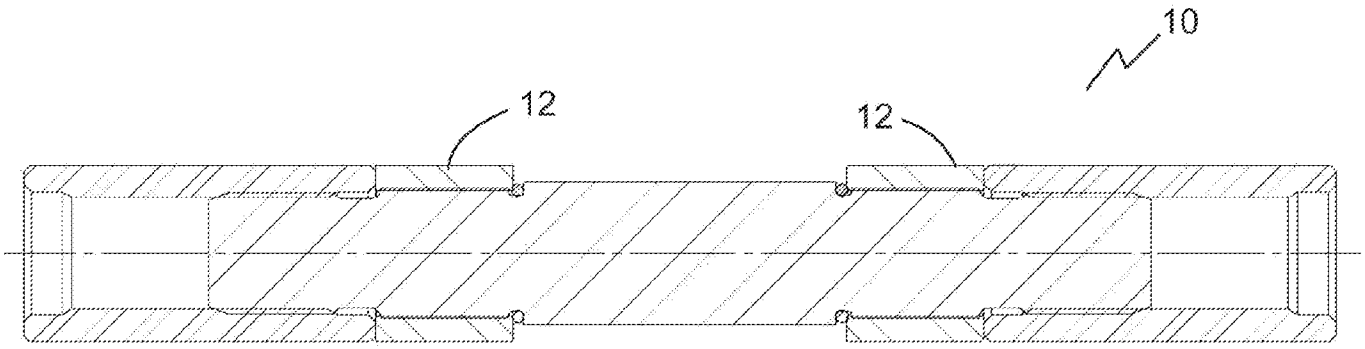
FIG. 12A is a section view taken along the A-A section lines of FIG. 12.
Figure 12:
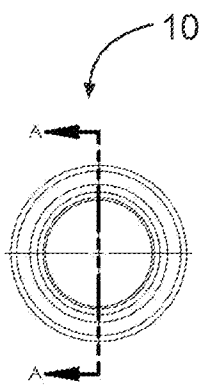
FIG. 12 is an end elevation view of a coupling assembly connected to a first threaded-end member and a second threaded-end member, and with the rotor removed, the mandrel having two nuts.

FIGS. 1, 1A, and 2 show a coupling assembly 10. In order to both satisfy the requirement for transmission of high torques to securely fix the rotor in one embodiment a circular nut 12 with O-ring was added on one (FIG. 1) or both (FIG. 12) side of a mandrel 11 (FIG. 1A) with two sets of pin threads 14 on either side to secure the rotor 16 (FIG. 3) in place. Reference numeral 12 is used throughout to interchangeably describe a shoulder or a nut. The shoulder may be defined by the mandrel, as is the left shoulder 12 in FIG. 1A. With this design the outer diameter of the nut(s) 12 is equal to the outer diameter of the coupling 20. This maximizes the bearing area resulting in the highest possible yield torque at the coupling-nut interface. In order to transmit this torque through the mandrel 11 the nut 12 threads may have a different pitch than the sucker rod threads 14. As the coupling advances on the sucker rod threads and engages the nut the difference in thread pitch prevents the nut threads 18 from advancing axially at a specified pre-torque thereby transmitting the stress caused by the applied torque by the sucker rod axially through the nut threads to the body of the mandrel 11. In this design the self-locking nuts secure the rotor 16 axially rather than the coupling faces.

The author's concept in one embodiment involves a mandrel 11 (FIG. 3) with two circular nuts 12 that secure the rotor 16 axially. The nuts have an outer diameter preferably equal to but may be less than that of the sucker rod coupling 20 in order to maximize and bearing area and yield torque required to cause material failure at the coupling-nut interface 22 located on the box face of the sucker rod pin threads 14. A vaned rotor 16 is loosely fit over the mandrel 11 and has a length slightly less than that of the space between the nuts 12.

To assemble the loosely fit rotor onto the mandrel one nut is thread hand tightened on one end of the mandrel then the rotor is slid onto the mandrel then the other nut is threaded onto the mandrel, and the entire assembly is pre-torqued as specified by the author. In a one nut embodiment (FIGS. 1 and 1A) only one nut 12 is tightened.

The attached drawings showing various views and a cross-section of the sucker rod centralizer assembly is referred to. In one embodiment, a solid mandrel with two circular nuts on either end is provided for connecting sucker rod segments with sucker rod couplings. The sucker rod guide centralizer is used to center the sucker rod string within the tubing string and prevents wear of the tubing string. The centralizer assembly is designed for connecting and centralizing the segments in a sucker rod string driving an oil well downhole pump such as a progressing cavity pump or a reciprocating pump. The centralizer assembly comprises a cylindrical mandrel, two circular nuts or preferably only one circular nut as shown in the FIG. 1A, a centralizer rotor 16 FIG. 3) and a pair of sucker rod couplings 20. The coupling-nut interface results in the maximum possible bearing surface contact between the mandrel and the couplings allowing for the mandrel to transfer significantly more torque than a one-piece sucker rod guide centralizer assemblies without material yield. The nuts have a different thread pitch than that of the sucker rod threads. This causes the nut to self lock at a certain point as the nut threads advance. The stress caused by the torque applied at the coupling-nut interface is then transmitted to the mandrel through the threads of the nut. The nuts also result in the maximum possible contact area in the nut-centralizer interface allowing large axial forces to be applied to the rotor without material yield.

The mandrel is a circular piece, with a set of sucker rod threads and a set of nut threads on one or both sides. The nut or nuts are generally cylindrical with flats on the outer diameter in order to pre-torque the assembly. The centralizer rotor is a tubular sleeve with raised fins 23 (FIG. 3) formed of non-metallic soft resilient abrasion-resistant material, such as polyurethane or high temperature nylon, and fits loosely upon the cylindrical surface of the mandrel undercut. The rotor fins allows fluid to flow within the tubing string while preventing tubing wall wear from the metallic components of the sucker rod string and the sucker rod guide centralizer assembly.

The threaded nut-mandrel interface designed such that the applied torque from the sucker rod is resisted by the torque produced at the bearing surfaces located on the box and pin faces of the coupling-nut interface in addition to the torque produced by the sucker rod threads. In order to prevent material failure at the coupling-nut bearing surface the surface area is maximized by making the nuts outer diameter equal to that of the coupling. The applied torque is then transmitted by the self-locking nut or nuts to the mandrel. The thread or threads at the nut-mandrel interface are sufficiently long to prevent thread shear and provide a margin of safety for the new thread design and foster acceptance of the present disclosed embodiments within industry.

Figure 5:
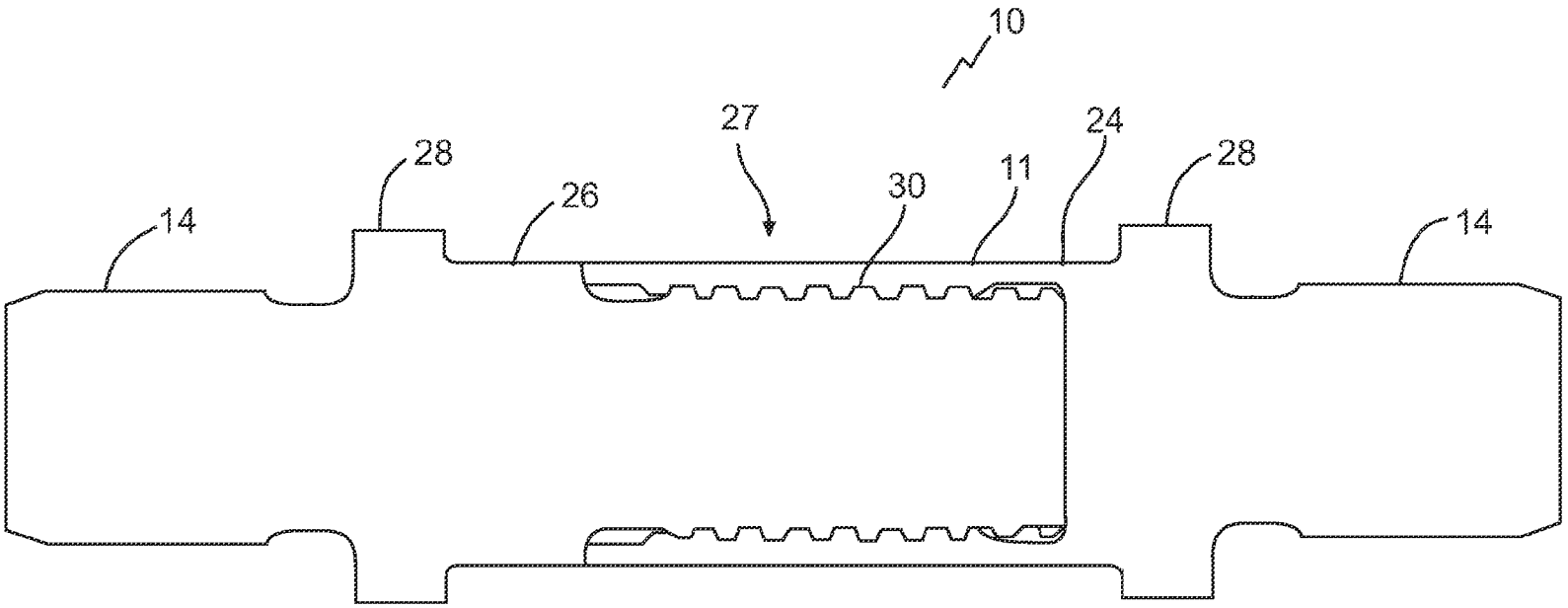
FIG. 5 is a side elevation section view of another embodiment of a split mandrel assembly with the rotor removed.
Figure 6A:
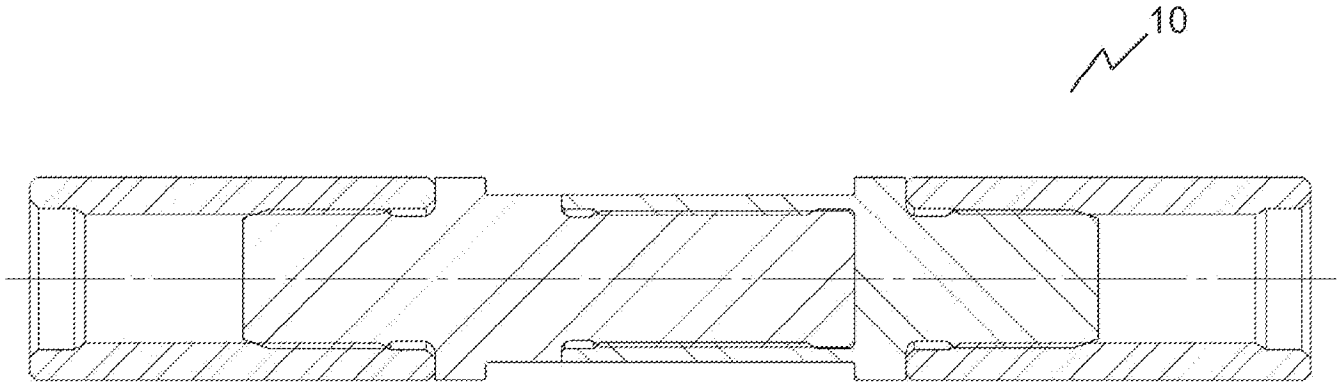
FIG. 6A is a section view taken along the A-A section lines of FIG. 6.
Figure 6:
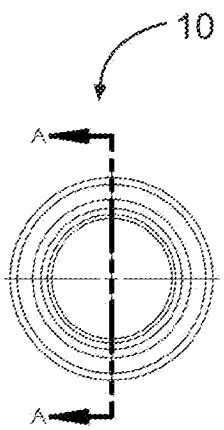
FIG. 6 is an end elevation view of a coupling assembly connected to a first threaded-end member and a second threaded-end member, and with the rotor removed, the mandrel being split, with a pin on either end.
Figure 7:
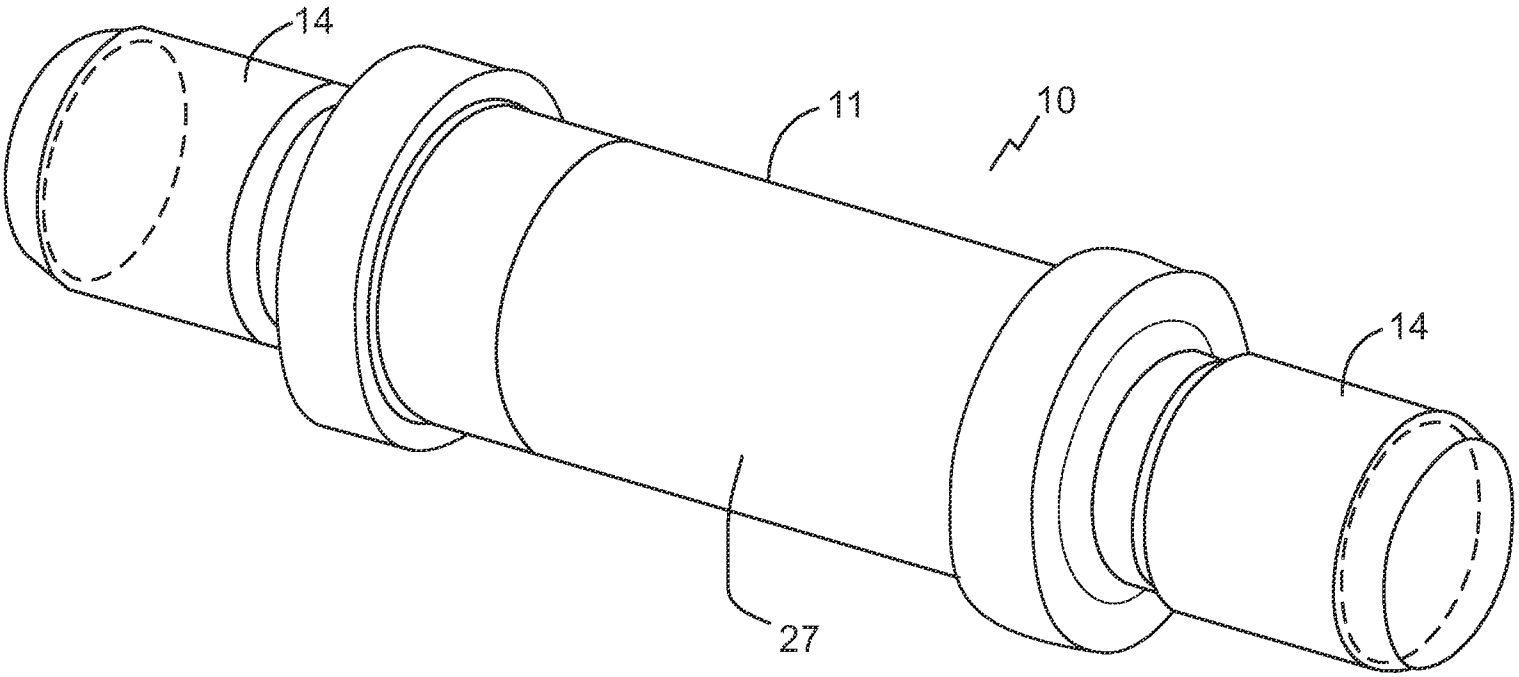
FIG. 7 is a perspective view of the split mandrel assembly of FIG. 6A with the threaded-end members removed.
Figure 8:
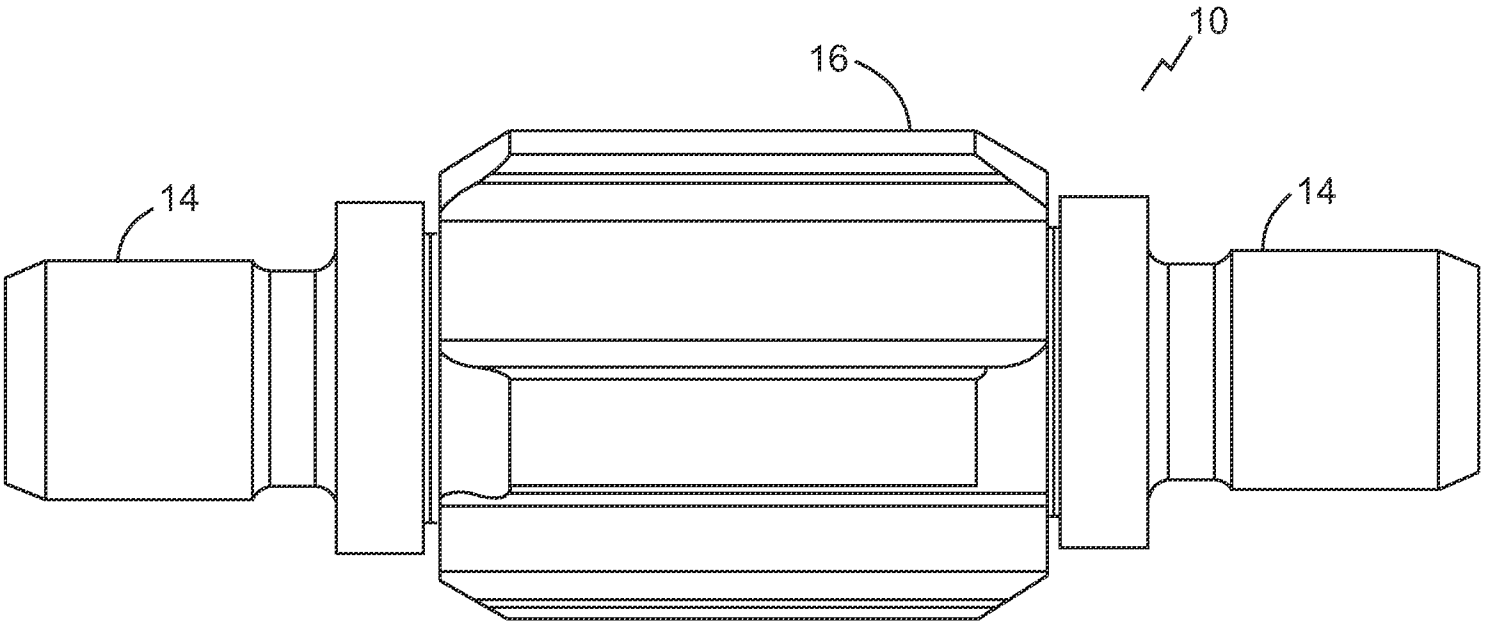
FIG. 8 is a side elevation view of the coupling assembly of FIG. 3 with the threaded-end members removed.
Figure 9:
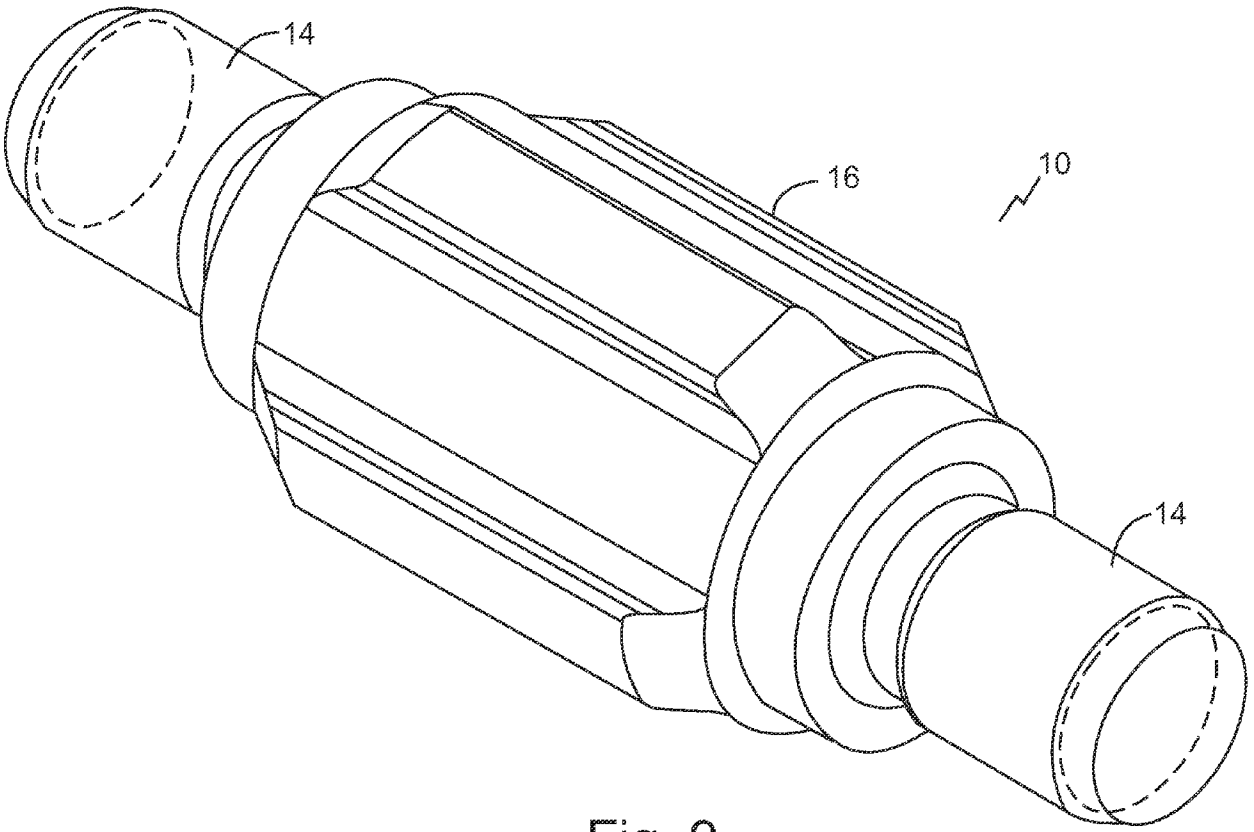
FIG. 9 is a perspective view of the coupling assembly of FIG. 8.
Figure 10A:
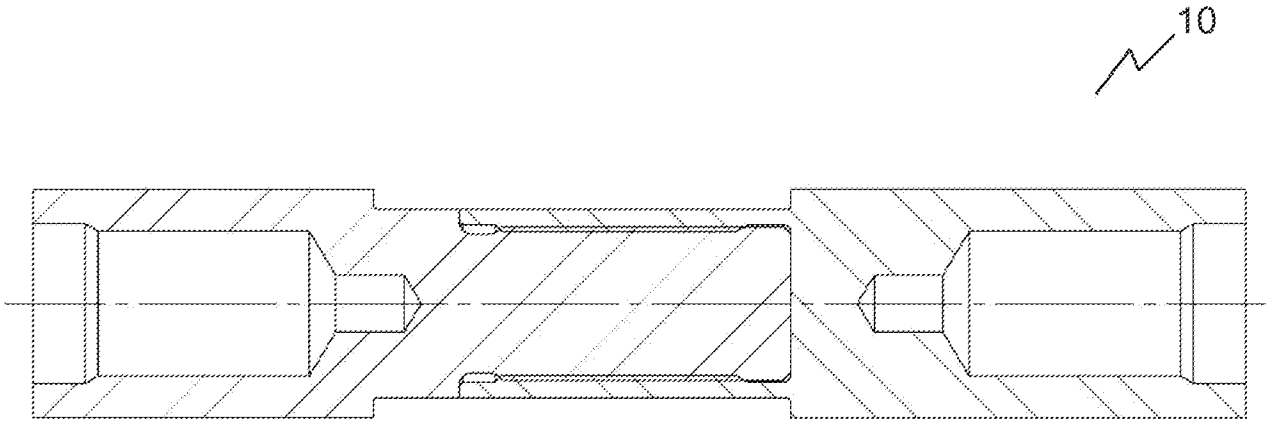
FIG. 10A is a section view taken along the A-A section lines of FIG. 10.
Figure 10:
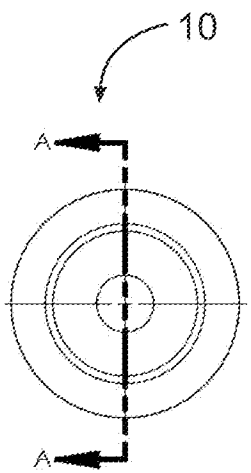
FIG. 10 is an end elevation view of a split coupling assembly with the rotor removed, the coupling having a box on either end.
Figure 11A:
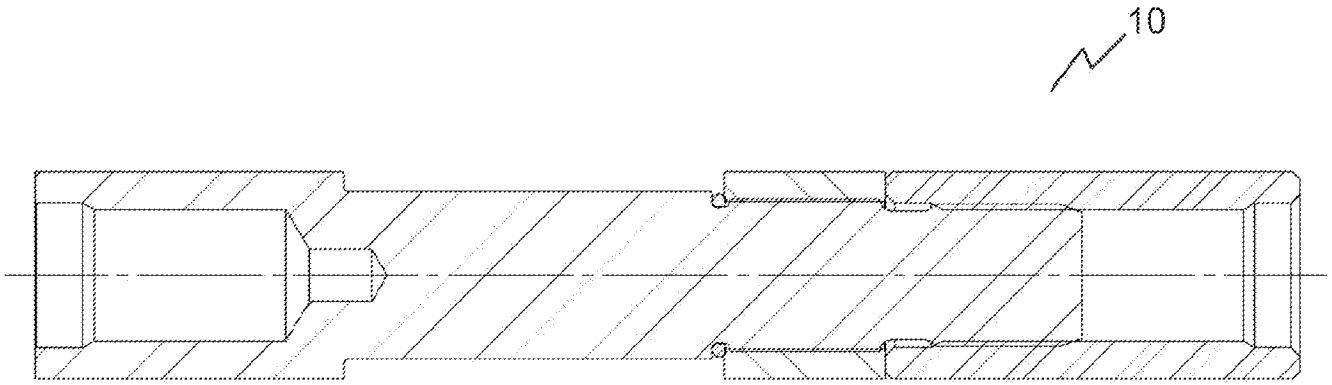
FIG. 11A is a section view taken along the A-A section lines of FIG. 11.
Figure 11:
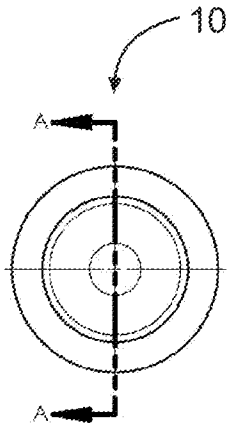
FIG. 11 is an end elevation view of a coupling assembly connected to a first threaded-end member and with the rotor removed, the mandrel having a box on one end and a pin on the other end.

Referring to FIG. 5, in other embodiments, the nuts 12 are eliminated and the mandrel design is modified and split into two pieces 24, 26. The modified mandrel has an undercut 27 (rotor receiving surface) forming raised edges 28 to secure the centralizer 16 (FIG. 9) axially. In order to assemble the mandrel it is split in two pieces. The rotor is slid on one half of the mandrel resting against the undercut then the other half of the mandrel threads into the first half. The threads 30 at the central connection are designed to have a higher yield torque than that of the threads 14 at the pin ends despite having a smaller bearing surface at the mandrel-mandrel interface than the coupling-mandrel interface. In still other embodiments, the centralizer rotor is molded onto to a modified mandrel during manufacture. The modified mandrel has an undercut forming raised edges to secure the centralizer axially and the mandrel is one piece, with no threaded section.

In a second embodiment, an undercut was added to the mandrel to secure the rotor. With this design the mandrel shoulders are the same diameter as the coupling, or may be slightly less diameter, and allow the entire surface of the coupling to become the bearing area resulting in the maximum yield torque of the mandrel at the sucker rod connection and the undercut secures the rotor rather than the coupling face.

In the second embodiment, the mandrel is a two-piece (or more) mandrel with an undercut to secure the rotor with a raised shoulder with an outer diameter equal to, or slightly less than, that of the sucker rod coupling in order to maximize and bearing area and torque required to cause material failure at the bearing surface located on the box face of the sucker rod pin threads. A vaned rotor is loosely fit over the mandrel and has a length slightly less than that of the mandrel undercut. The rotor is fixed axially between the shoulders of the mandrel undercut.

To assemble the loosely fit rotor onto the mandrels undercut design there is a two-piece mandrel which threads together in the central area within the undercut. The rotor is slid onto one half of the mandrel then the other half of the mandrel slides in the rotor and threads into the first half of the mandrel.

The attached drawings showing various views and a cross-section of the second embodiment of the sucker rod coupling are referred to. In one embodiment, a two-piece sucker rod guide centralizer assembly is provided for connecting sucker rod segments with sucker rod couplings. The sucker rod guide centralizer is used to center the sucker rod string within the tubing string and prevents wear of the tubing string. The centralizer assembly is designed for connecting and centralizing the segments in a sucker rod string driving an oil well downhole pump such as a progressing cavity pump or a reciprocating pump. The centralizer assembly comprises a two-piece cylindrical mandrel, a centralizer rotor and a pair of sucker rod couplings. The two-piece cylindrical mandrel has an undercut in which the centralizer rotor is fixed axially by the shoulders of the undercut. This undercut allows the maximum possible bearing surface contact between the mandrel and the couplings allowing for the mandrel to transfer significantly more torque than a one-piece sucker rod guide centralizer assemblies without material yield. The undercut also allows the maximum possible contact on the flat face of the rotor with the undercut shoulder allowing large axial forces to be applied to the rotor without material yield.

The two-piece mandrel is connected in the central area of the mandrel by any of various thread designs, but it is preferred that the thread has a higher yield torque than the sucker rod pin ends while having a smaller bearing surface between the two pieces of the mandrel when compared to the bearing surface between the mandrel undercut and the sucker rod coupling. The centralizer rotor is a tubular sleeve with raised fins formed of non-metallic soft resilient abrasion-resistant material, such as polyurethane and fits loosely upon the cylindrical surface of the mandrel undercut. The rotor fins allow fluid to flow within the tubing string while preventing tubing wall wear from the metallic components of the sucker rod string and the sucker rod guide centralizer assembly.

The threaded connection is preferably designed such that the applied torque is resisted by the torque produced at the bearing surfaces located on the box and pin faces of the connection in addition to the torque produced by the threads. In order to prevent material failure at the box bearing surface the connection is preferably designed to produce the most resistive torques at the pin bearing surface and along the threads. The central mandrel connection is also preferably designed to have a higher failure torque than the sucker rod pin threads to provide a margin of safety for the new thread design and foster acceptance of the present disclosed embodiments within industry.

In other embodiments, the centralizer rotor is molded onto to the mandrel undercut during manufacture and the central mandrel is one piece, with no threaded section. In still other embodiments, the threaded connection makes contact on the box face of the shaft alone and in another the threaded connection makes contact on the pin face of the shaft alone.

The connection has three potential failure points at maximum torque: 1) the threads, 2) the box bearing area and 3) the pin bearing area. Preferably, the connection is designed to maximize torque transmission by balancing the material failure at each location, but to have the box bearing area marginally fail first by design. i.e. when the connection has full torque on it, the threads and pin bearing are loaded to 90% of failure, and the box bearing is loaded to 95% of failure.

Immaterial modifications may be made to the devices disclosed here without departing from what is claimed. In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The invention claimed is:

1. A coupling assembly for connecting and centralizing a threaded-end member and a box coupling, the coupling assembly comprising:

a mandrel having a rotor receiving surface, the mandrel having a first threaded end and a second threaded end, the first threaded end for connecting to the threaded-end member;

the second threaded end having a first threaded portion for connecting to the box coupling and a second threaded portion for receiving a nut, the second threaded portion located between the first threaded portion and the rotor receiving surface;

a stop formed on the mandrel between the first threaded end and the rotor receiving surface;

the first threaded portion having a first thread pitch and the second threaded portion having a second thread pitch, the first thread pitch being different from the second thread pitch and the first threaded portion being narrower in diameter than the second threaded portion;

a nut threaded onto the second threaded portion; and a rotor with raised fins, the rotor being mounted on the rotor receiving surface between the nut and the stop and being movable axially on the rotor receiving surface.

2. The coupling assembly of claim 1 in which the stop is formed by a shoulder on the mandrel.

3. The coupling assembly of claim 2 in which the shoulder has a shoulder outer diameter, the threaded-end member has a member outer diameter, the nut has a nut outer diameter, the box coupling has a coupling outer diameter, the shoulder outer diameter is less than or equal to the member outer diameter, and the nut outer diameter is less than or equal to the coupling outer diameter.

4. The coupling assembly of claim 3 in which the shoulder outer diameter is equal to the member outer diameter, and the nut outer diameter is equal to the coupling outer diameter.

* * * * *